United States Patent [19]

Smal

[11] Patent Number: 4,733,655

[45] Date of Patent: Mar. 29, 1988

[54] ELECTRIC MASSAGE APPLIANCE

[75] Inventor: Henri Smal, Blegny, Belgium

[73] Assignee: S.A. Faco, Herstal, Belgium

[21] Appl. No.: 905,836

[22] Filed: Sep. 10, 1986

[30] Foreign Application Priority Data

Sep. 20, 1985 [LU] Luxembourg ..... 86 084

[51] Int. Cl.[4] ..... A61H 7/00

[52] U.S. Cl. ..... 128/61; 128/60

[58] Field of Search ..... 128/60, 61, 44, 46, 128/48, 59, 49, 54, 55, 62 R, ; 400/479, 490, 495

[56] References Cited

U.S. PATENT DOCUMENTS

| | | | |
|---|---|---|---|
| 2,038,846 | 4/1936 | Matson | 128/67 |
| 2,232,493 | 2/1941 | Stuckey | 128/46 |
| 3,448,419 | 6/1969 | Myatt | 400/479 |

FOREIGN PATENT DOCUMENTS

| | | | |
|---|---|---|---|
| 0044107 | 1/1982 | European Pat. Off. | 128/62 R |
| 2045616 | 11/1980 | United Kingdom | 128/52 |

*Primary Examiner*—Edgar S. Burr
*Assistant Examiner*—Huong Q. Pham
*Attorney, Agent, or Firm*—Karl F. Ross; Herbert Dubno

[57] ABSTRACT

The appliance is of the type in which a plurality of fingers move in succession towards and away from one another. The fingers are each covered with an elastic cap having a rounded crown. The cap consists of a cylindrial portion and a bellows-shaped base, a sleeve of rigid material being fixed in the cylindrical part of the cap while being capable of turning and sliding on its finger.

1 Claim, 3 Drawing Figures

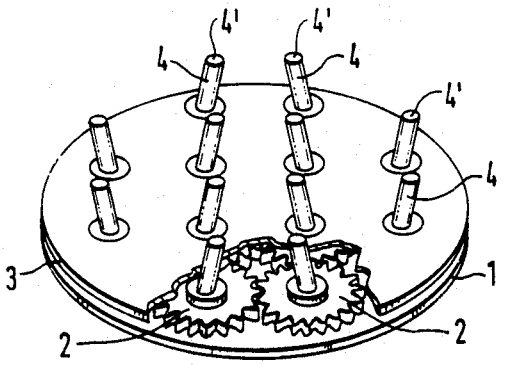
Fig.1
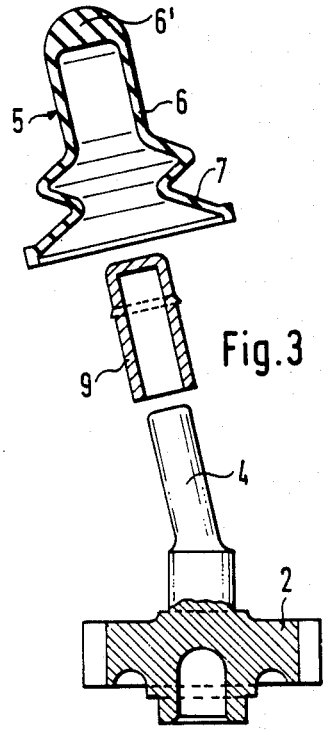
Fig.3
Fig.2
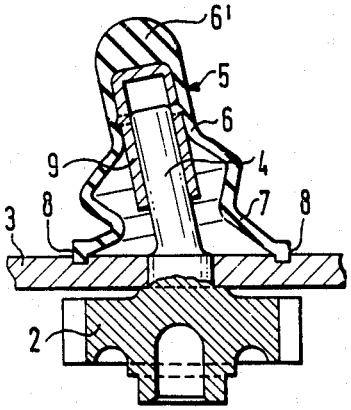

ELECTRIC MASSAGE APPLIANCE

FIELD OF THE INVENTION

The present invention relates to an electric massage appliance, which uses a plurality of fingers moving alternately toward and away from one another.

BACKGROUND OF THE INVENTION

Movements of fingers of an electric message appliance can be generated by a train of gears driven by a motor through a reduction gear. These appliances produce movements of an amplitude and a frequency compatible with human physiology by contrast with aggressive and badly tolerated vibrating devices.

OBJECT OF THE INVENTION

The object of the present invention is to provide an electric massage appliance of the type described above, wherein the fingers are shaped to avoid the friction effect produced by rotation of the fingers on themselves and moreover to enable the fingers to adapt to the concave or convex form of the parts of the body which are to be massaged.

SUMMARY OF THE INVENTION

The massage appliance according to the invention has each of the fingers is covered by an elastic cap, the crown of which is rounded.

According to the invention, the cap consists of a cylindrical part, ending in a rounded crown, and a base in the form of a bellows.

Again according to the invention, in the cylindrical part of the cap there is fixed a sleeve of rigid material, adapted to turn and slide on its finger.

BRIEF DESCRIPTION OF THE DRAWING

In order that the invention may be more clearly understood, it is described in greater detail hereinafter and solely by way of example, with reference to the accompanying drawing, in which:

FIG. 1 is a perspective view of the support means and of the fingers of an electric massage appliance of the type described, with part of the upper plate cut away;

FIG. 2 is a section through the top plate, broken away at the location of a finger, showing the covering of the latter according to the invention; and FIG. 3 is an exploded view of the section in FIG. 2.

SPECIFIC DESCRIPTION

An electric massage appliance of the type described above and diagrammatically shown in FIG. 1 comprises a support means constituted by a double plate, that is to say a lower plate 1 carrying a train of straight-cut gears 2 with vertical axes connected to an external drive means (not shown) and an upper plate 3 perforated to allow passage and finally projection of fingers 4 consisting of pins each rigid with a gear 2 and inclined in relation to the axis of rotation of the gear, so that their tips 4' perform alternating movements away from and toward one another.

According to the invention, the covering of the fingers 4 is a cap 5 of flexible and elastic material, comprising a cylindrical portion 6 ending in a rounded crown 6', to ensure an agreeable and effective action, and a bellows 7 at its base, anchored at 8 in an annular slot on the upper face of the upper plate 3 to prevent rotation of the cap on itself i.e. about its own axis as its crown orbits around the axis of the respective gear. Instead of being so by virtue of its material, the cap may be made elastic by any appropriate method or means.

Fixed in the cylindrical part 6 is a sleeve 9 of rigid material, adapted to rotatably receive and slide on the pin or finger 4 rigid with the gear 2.

The elastic conformation of the caps 5 according to the invention allows these latter at once to describe a circular orbital movement at their crowns without twisting themselves and to slide axially on the pin 4 with a spring action produced by the elasticity and so to adapt to the concave or convex form of the parts of the body which are to be massaged.

I claim:

1. A massaging device comprising:

a plate formed with a multiplicity of holes;

respective fingers having bases rotatably journaled in said holes and extensions inclined to the respective bases and projecting from one side of said plate;

means on another side of said plate opposite said one side from which said extensions project for driving said fingers in an alternating approach and separating manner and including intermeshing gears each affixed to a respective one of said bases and rotatable to cause the respective extension to orbit an axis of the respective gear; and a respective elastic cap fitted over each of said extensions and having a rounded crown receiving the tip of the respective extension and a bellows portion extending between the crown and said one side of the plate from which said extensions project and completely surrounding the respective extension, said extensions being rotatable in the respective caps so that said caps are orbited by said extensions without causing said caps to rotate relative to said plate, said massaging device further comprising a respective rigid sleeve received in each cap and interposed between each cap and the respective extension, said extensions being rotatable in the respective sleeves.

* * * * *